United States Patent [19]

Fraser et al.

[11] Patent Number: 4,966,469

[45] Date of Patent: Oct. 30, 1990

[54] POSITIONING DEVICE FOR TEMPERATURE SENSOR IN FREEZE DRYING

[75] Inventors: Douglas S. Fraser, Bloomington; Taylor N. Thompson, Sr., Kingston, both of N.Y.

[73] Assignee: FTS Systems, Inc., Stone Ridge, N.Y.

[21] Appl. No.: 459,534

[22] Filed: Jan. 2, 1990

[51] Int. Cl.[5] ..... F26B 21/10

[52] U.S. Cl. ..... 374/208; 34/5; 34/55

[58] Field of Search ..... 374/208, 179; 34/5

[56] References Cited

U.S. PATENT DOCUMENTS

| | | | |
|---|---|---|---|
| 2,647,237 | 7/1953 | Herbst | 374/179 X |
| 4,163,327 | 8/1979 | Thompson et al. | 34/5 |
| 4,344,917 | 8/1982 | Schorno | 73/863.12 X |
| 4,619,054 | 10/1986 | Sato | 34/5 X |

FOREIGN PATENT DOCUMENTS

| | | | |
|---|---|---|---|
| 1124225 | 11/1984 | U.S.S.R. | 374/210 |

*Primary Examiner*—Daniel M. Yasich

*Attorney, Agent, or Firm*—Wallenstein, Wagner & Hattis, Ltd.

[57] ABSTRACT

A positioning device for a temperature sensor in a flask for freeze drying. The device comprises a generally circular plastic stopper having an opening approximately in its center. The stopper is snap-fittingly secured to the top of the flask. A central, annular tube extends through that opening and into the flask. A thermocouple having a generally circular cross section is coiled around and supported by the annular tube so that it is free and is in the center of the flask. The thermocouple is retractable and extensible to permit the use of the thermocouple in flasks of various lengths.

7 Claims, 1 Drawing Sheet

POSITIONING DEVICE FOR TEMPERATURE SENSOR IN FREEZE DRYING

TECHNICAL FIELD

This invention relates in general to a freeze drying apparatus. More particularly, it relates to a positioning device for a temperature probe or sensor used in freeze drying.

BACKGROUND OF THE INVENTION

Freeze drying has been proven useful in many fields, including food processing and laboratory analysis of organic materials. Freeze drying enables the removal through sublimation of solvents, including water, from a substance without destroying its cellular structure. Through sublimation, the substance being freeze dried remains in a frozen, solid form until it is dried, i.e., until all of the liquid is removed from that substance.

Sublimation occurs when the frozen substance is heat treated in a proper manner. If improperly treated, the frozen solvent within the substance melts rather than vaporizes, damaging the substance and often rendering it unusable. The temperature level within the flask typically used for freeze drying is critical to proper sublimation.

In a common freeze drying operation, one end of a drying flask is secured to the manifold of a conventional freeze drying apparatus, such as that shown and described in U.S. Pat. No. 4,017,983, issued to Douglas S. Fraser on Apr. 19, 1977, and entitled "Freeze Dryer." In another common operation, the drying flasks are placed in a so-called tray dryer. Typically, the volume of these flasks is between five (5) and one-hundred (100) milliliters.

In tray drying, the temperature of the substance within one drying flask on the tray is monitored by a thermocouple. To ensure proper temperature monitoring, the thermocouple must extend through the length of the substance and its end, the point of highest sensitivity, must be adjacent to but not contacting the bottom center of that flask. The thermocouple will then determine the temperature of the substance in the central lower portion of the flask.

The freeze drying of a substance occurs at the ice interface. It follows, therefore, that a substance contained in a flask will dry from the top downward and from the sides inward, thus leaving the bottom central section the last portion to dry. Since the drying of a substance is accompanied by a rise in temperature, it becomes essential to monitor temperature at this critical point so that one may control the freeze drying process accurately either by manual or automatic means.

Currently, manufacturers do not provide either acceptable mounting regimens or mounting hardware for their thermocouples. Hence, the operator of freeze drying equipment is left to his own skill and imagination in securing the thermocouple to the flask. Unless the thermocouple is placed at a correct location within that flask, and unless that thermocouple remains fixed at that location, incorrect temperature information can be transmitted to the operator or the electronic controls determining the process parameters. This in turn can lead to improper adjustments of temperature, and damage to or destruction of the substance being freeze dried.

Some examples of modern freeze-dryers are disclosed in U.S. Pat. Nos. 4,823,478 and 4,780,964. Assuming correct thermocouple placement, tray drying in these modern freeze-dryers can give excellent results when operated by even relatively inexperienced personnel. Unfortunately, such inexperienced personnel often lack either the knowledge necessary for correct placement of the thermocouple, or an appreciation of its importance.

For all of the above reasons, the inventors of the present invention have invented a positioning device for a temperature sensor in a freeze-drying flask.

SUMMARY OF THE INVENTION

The present invention is a positioning device for a temperature sensor in a flask for freeze drying. The device comprises a generally circular stopper having an opening approximately in its center. The stopper with this central opening is pressed into to the top of the flask. An annular tube, of reduced diameter relative to the stopper and sized to be press fitted into the opening, extends into the flask. A thermocouple is coiled around and supported by the lower part of the annular tube. The thermocouple is retractable and extensible to permit the use of the thermocouple in flasks of various lengths.

In another embodiment of the invention, the thermocouple is of a generally circular cross-section, and has a diameter of approximately 0.020 inches. In still another embodiment of the invention, the stopper is made of a plastic material.

An object of this invention is a positioning device for a temperature sensor which may be used on freeze drying flasks of various sizes. A further object of the invention is a positioning device which may be placed on a flask without interfering with the subliming vapor flow from that flask. A still further object is a positioning device which is both supported by and extendable and retractable along its central, annular tube.

DETAILED DESCRIPTION OF THE PREFERRED EMBODIMENT

Figure 1:
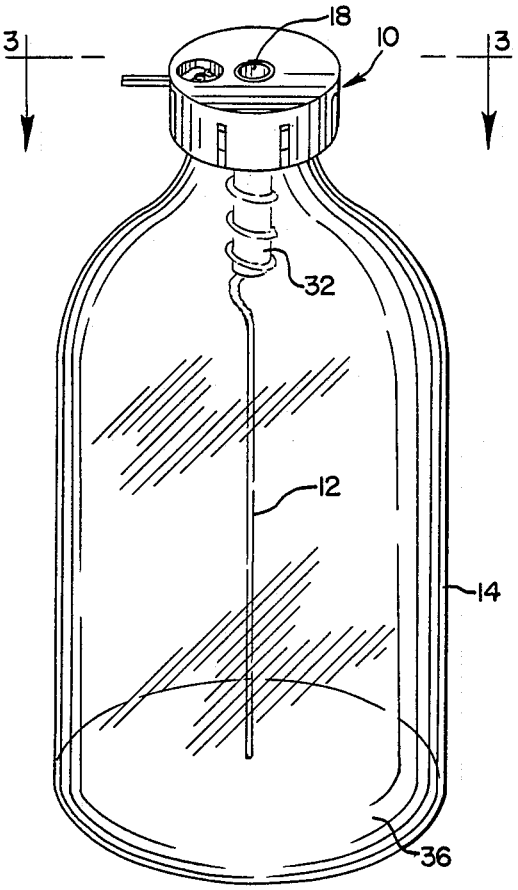
FIG. 1 is a perspective view of the positioning device of the present invention, while in place in a relatively large freeze drying flask.

The FIGURES show the present invention in a typical environment, i.e., a freeze drying flask. FIG 1 shows the positioning device 10. The device 10 is used to ensure proper placement of a temperature sensor 12 within that flask 14. In the embodiment shown in FIG. 1, the flask has a volume of approximately one-hundred (100) milliliters.

The positioning device 10 is formed into a stopper 16 and is of generally circular shape. It may be formed of plastic, rubber or the like. Incorporated with this one-piece stopper 16 is a mouth-engaging wall portion 20 which fits snugly along the inner walls of the mouth of the flask 14.

The stopper 16 further includes an opening 18 at its approximate center which extends through the stopper. The stopper 10 may be snap-fittingly secured to the top of the flask 14. In the present embodiment, this securement is facilitate by a ridge 22 integral with the lower periphery of the ring 24 of the stopper 10.

When the stopper 16 is in place on the flask 14, the ridge 22 abuts against and snap-fittingly engages the lower end 26 of a flange 28. In order for the ridge 22 to snap-fittingly engage the lower end 26 of that flange 28, the resilient plastic comprising the underside 30 of the stopper 16 is compressed by pushing the stopper-like portion 20 into the mouth of the flask 14 and beyond the point where the underside 30 first contacts the top of the flange 28. The ridge 22 is snap-fittingly secured to the lower end 26 of the flange 28 by pressing it into place. When the pushing force is removed, the underside 30 attempts to resume its original, uncompressed configuration. The resulting forces between the underside 30 and the top of the flange 28 cause the stopper to be securely retained against the mouth of the flask 14.

In this embodiment, freeze drying is effected by placing the flask 14 in a tray dryer. The flask 14 will be the monitored sample, while the other samples will simply contain conventional split stoppers which are unseated until after the drying process is complete. A central, annular tube 32 press-fitted into and extending through the stopper 16 and into the flask 14 permits subliming vapors to escape from the flask. In practice, the opening in the tube 32 closely approximates the combined total area of the openings in the split stoppers which are used in the non-monitored sample.

As indicated above, the positioning means 10 also includes a temperature sensor 12 or thermocouple. In the present embodiment, the thermocouple 12 has a diameter of approximately 0.020 inch. The placement of this thermocouple 12 is important to the success of the manual or automated freeze drying process. Any movement of that thermocouple after its initial, correct placement can result in failure of the process, with the resultant destruction of the substance being freeze dried in the monitored sample as well as the other samples.

Accordingly, the thermocouple 12 of the present positioning device is coiled around and supported by the annular tube 32. This thermocouple has a generally circular cross-section.

Figure 2:
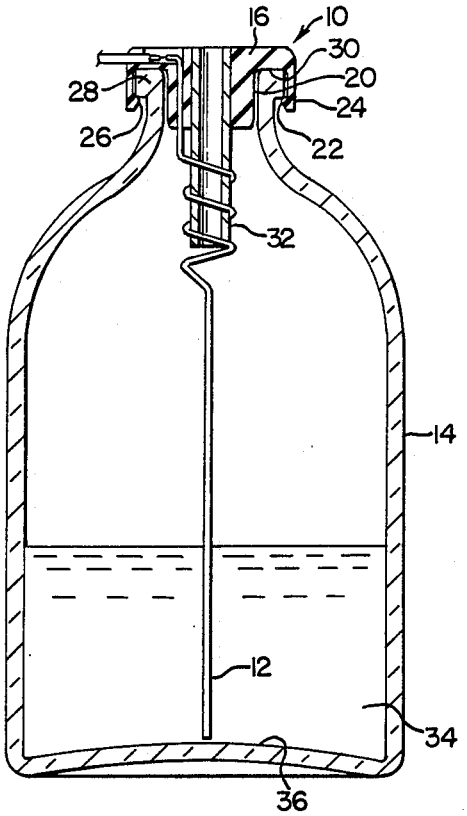
FIG. 2 is a side sectional view of the positioning device and flask of FIG. 1.
Figure 3:
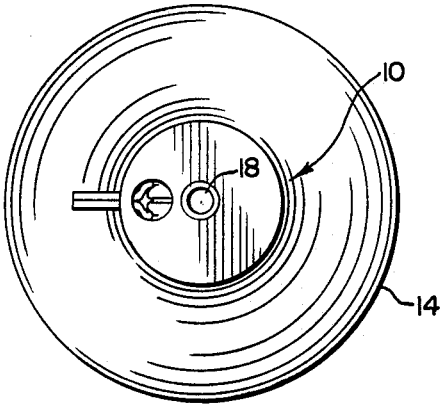
FIG. 3 is a top view, taken along lines 3—3 of FIG. 1, of the positioning device and flask of FIGS. 1 and 2.
Figure 4:
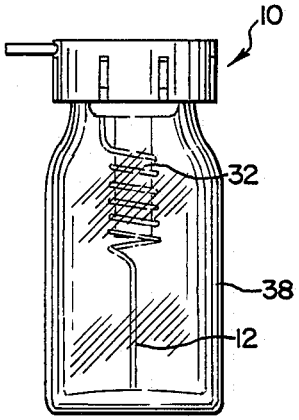
FIG. 4 is a side sectional view of the positioning device of FIGS. 1 and 2, positioned in a smaller freeze drying flask.

As may be seen from a comparison of FIGS. 2 and 4, the extent of coiling of the thermocouple of the present invention is dependent upon the size of the flask in which the positioning device is used. In the large, 100-milliliter flask of FIG. 2, a substantial portion of the thermocouple 12 is extended into and along the central axis of the flask. In contrast, when the positioning device is placed within the small, 5-milliliter flask 38 of FIG. 4, most of the thermocouple 12 is coiled around the annular tube 32.

In both instances, the coiling around the tube 32 stabilizes that thermocouple 12, locates it centrally in the flask, just slightly above the bottom of the flask such 1/16–1/32 inch. This helps to prevent its inadvertent movement after placement within the flask. In addition, when the present positioning device 10 is consistently used in a flask of a given size, the thermocouple 12 need not be coiled upon or uncoiled from the tube 32. This can ensure the accurate placement of the thermocouple in such a flask by even the most inexperienced personnel, preventing the loss of substances undergoing freeze drying through improper temperature monitoring.

As may be seen in FIG. 2, in the embodiment described above the material 34 to be freeze-dried has been "stub" frozen in a plug-like structure at the bottom 36 of the flask 14. As drying within the tray dryer begins, vapors from the solvent under sublimation move past the thermocouple 12 and out of the flask 14 through the annular tube 32. The temperature of these vapors, which is sensed by the thermocouple 12, corresponds closely to the temperature of the frozen solvent within this material 34. That temperature is important in determining the sequence and timing of operations to be performed during the freeze drying process. This allows monitoring of one sample on the tray which, in turn, reveals the condition of the other samples in the tray. In this way, the freeze drying process of all samples may be controlled with stoppering to be accomplished when the monitored sample indicates that drying is complete.

While the specific embodiments have been illustrated and described, numerous modifications come to mind without markedly departing from the spirit of the invention. The scope of protection is thus only intended to be limited by the scope of the accompanying claims.

We claim:

1. In a flask for freeze drying, a positioning device for a temperature sensor, comprising:

a. a generally circular stopper having an opening approximately in its center, said stopper being snap-fittingly secured to the top of said flask;

b. a central, annular tube extending through said opening and into said flask; and c. a thermocouple coiled around and supported by said annular tube, said thermocouple being retractable and extensible to permit the use of said thermocouple in flasks of various lengths.

2. The positioning device of claim 1, wherein said thermocouple is of a generally circular cross section, and having a diameter of approximately 0.020 inch.

3. The positioning device of claim 1, wherein said stopper is made of a plastic material.

4. The positioning device of claim wherein a portion of said thermocouple below said annular tube is located substantially along the axis of said flask.

5. In a flask for freeze drying, a positioning device for a temperature sensor, comprising:

a. a stopper having an opening, said stopper being secured to the top of said flask;

b. an annular tube extending through said opening and into said flask; and c. a thermocouple coiled around and supported by said annular tube, said thermocouple being retractable and extensible to permit the use of said thermocouple in flasks of various lengths.

6. In a flask for freeze drying, a positioning device for a temperature sensor, comprising:

a. a generally circular plastic stopper having an opening approximately in its center, said stopper being snap-fittingly secured to the top of said flask;

b. a central, annular tube extending through said opening and into said flask; and c. a thermocouple coiled around and supported by said annular tube, said thermocouple having a generally circular cross-section and a diameter of approximately 0.020 inch, and said thermocouple being retractable and extensible to permit the use of said thermocouple in flasks of various lengths.

7. The positioning device of claim 6 wherein said flask is circular, and wherein a portion of said thermocouple located below said tube is centrally located within said flask.

* * * * *

UNITED STATES PATENT AND TRADEMARK OFFICE

CERTIFICATE OF CORRECTION

PATENT NO. : 4,966,469

DATED : October 30, 1990

INVENTOR(S) : Fraser et al.

It is certified that error appears in the above-identified patent and that said Letters Patent is hereby corrected as shown below:

Column 4, Claim 4, Line 39, after "claim" insert --1,--.

Signed and Sealed this

Tenth Day of March, 1992

*Attest:*

HARRY F. MANBECK, JR.

*Attesting Officer*

*Commissioner of Patents and Trademarks*